United States Patent [19]

Marano et al.

[11] 4,139,312

[45] Feb. 13, 1979

[54] DISPOSABLE TOOTHBRUSH

[75] Inventors: Carlos J. Marano; Enrique Capisano, both of Venado Tuerto, Argentina

[73] Assignees: Manuel Seinhart; Norberto Esteban Seinhart, both of Buenos Aires, Argentina

[21] Appl. No.: 727,753

[22] Filed: Sep. 29, 1976

[30] Foreign Application Priority Data

Dec. 4, 1975 [AR] Argentina ..... 261483

[51] Int. Cl.[2] ..... B43K 5/06

[52] U.S. Cl. ..... 401/176; 401/286

[58] Field of Search ..... 401/176, 177, 143, 146, 401/178–182, 149, 150, 286; 15/167

[56] References Cited

U.S. PATENT DOCUMENTS

| | | | |
|---|---|---|---|
| 2,243,774 | 5/1941 | Resh | 401/179 X |
| 2,668,973 | 2/1954 | Glaza et al. | 15/167 R X |
| 2,674,000 | 4/1954 | McDonald et al. | 401/176 |
| 2,732,576 | 1/1956 | Rosen | 401/176 |
| 3,417,762 | 12/1968 | Hall | 401/176 |
| 3,589,823 | 6/1971 | Hendrickson | 401/176 |

FOREIGN PATENT DOCUMENTS

| | | | |
|---|---|---|---|
| 512130 | 1/1955 | Italy | 401/176 |

*Primary Examiner*—Stephen C. Pellegrino

*Attorney, Agent, or Firm*—Fitzpatrick, Cella, Harper & Scinto

[57] ABSTRACT

A disposable toothbrush has a handle formed with a cavity which houses by friction a body with integral bristles extending therefrom. The body has a cylinder for a charge of dentifrice and a groove is provided in the handle for a piston which is manually movable to drive the dentifrice through an orifice in the body to the bristles.

2 Claims, 6 Drawing Figures

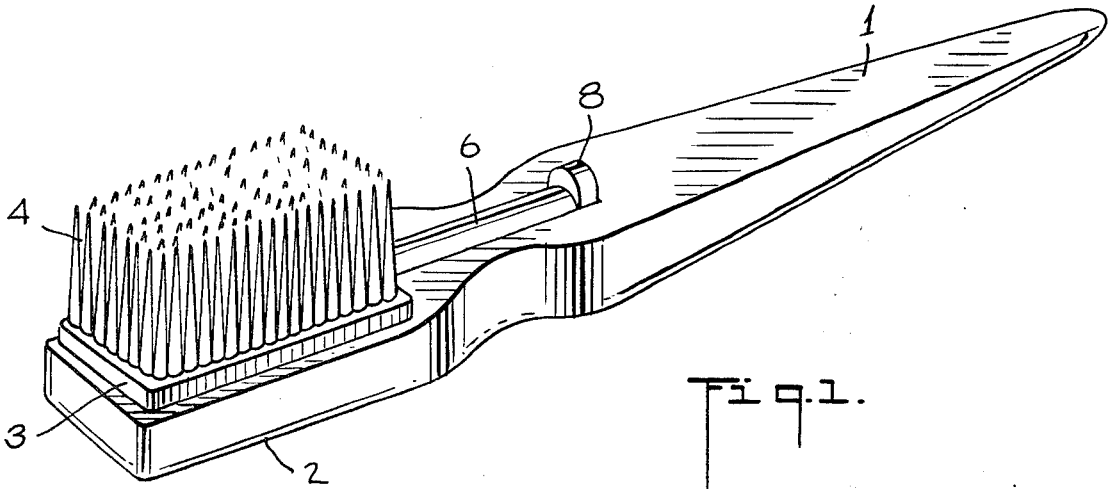
Fig. 1.
Fig. 2.
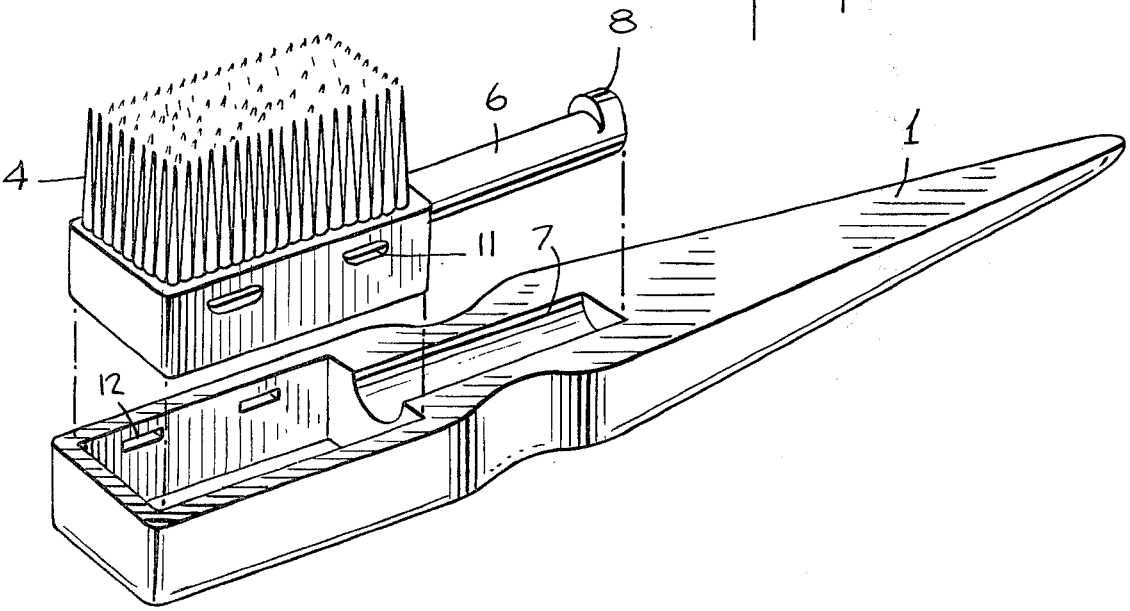

DISPOSABLE TOOTHBRUSH

BACKGROUND OF THE INVENTION

1. Field of the Invention

This invention relates to a throw-away toothbrush with means for dispensing toothpaste in sufficient quantity for at least one complete cleaning of the teeth, and more particularly to a toothbrush made of inexpensive synthetic material with a short useful life, so that after very little use, it loses the properties which make it suitable for satisfactory dental hygiene. One of its features is that it is equipped with a reservoir designed to contain toothpaste which, when a plunger that moves back and forth in the reservoir is pushed, can be transferred to the spaces between the bristles of the brush in order to facilitate proper cleaning.

More specifically, this invention relates to a throw-away low-cost toothbrush provided with necessary means of reaching the consumer with a sufficient charge of toothpaste to permit at least one complete cleaning of the teeth thereby constituting both the packaging of this toothpaste and the means for its application.

From what has been stated above, it can readily be deduced that the brush covered by this invention solves the problem of the suitable and necessary hygiene of the teeth after each meal outside the user's home.

Obviously, it is a known fact that for elementary reasons of hygiene, and even out of simple convenience, it is absolutely necessary to clean the teeth at least after each meal as it is then that food particles are lodged between the teeth with the well known pernicious consequences not only for the health of the teeth themselves, but also because of the many unpleasant sensations which they produce. However, according to conventional means, such cleaning normally requires the use of brushes and dentifrices, either in liquid or in paste form, all of which involves the need to carry along these elements. Because of the corresponding inconvenience, very few individuals follow this practice, especially if one bears in mind the fact that, after use, these implements have to be cleaned in order to be replaced either in a pocket of one's clothing, or in a pocketbook, container or the like. The toothbrush, practically down to the present time, has been a device which people have in their homes, the same as dentifrices, and when they eat meals elsewhere, they usually postpone brushing their teeth until they return home, which can be many hours later, during which time the accumulated food residues are having their harmful effects.

2. DESCRIPTION OF THE PRIOR ART

In order to remedy this disadvantage, many variations have been proposed of toothbrushes capable of being carried in one's pocket or purse, including some which can carry their own load of toothpaste in order to obviate the need to carry this second element, but practice has demonstrated that these methods have not received sufficiently wide acceptance, partly due to the cost and to the necessary concern for not forgetting them when leaving home.

Among the known proposals is that disclosed in U.S. Pat. No. 3,432,245 wherein the entire toothbrush handle serves as a cylinder and a piston extends beyond the end of the handle remote from the bristles to extrude a charge of dentifrice to the bristles when pushed into the cylinder. This device is relatively expensive and suffers from the disadvantages that the dentrifice is applied only to the inner end of the group of bristles, and more importantly, that when the device is carried in the pocket or purse, the piston or plunger may be inadvertently pressed toward the bristles to discharge the dentifrice.

Other examples of prior efforts are found in Argentine Pat. No. 189,034 and Patent of Addition thereto No. 199,225 of Carlos Jose Marano, the disclosures of which illustrate compressible sacks of dentifrice located in the brush handle for discharging dentifrice onto the bristles by compression of the sacks by the user's finger. These constructions are difficult to manufacture and do not enable all of the dentifrice to be discharged, and also suffer from the possibility of inadvertent discharge as mentioned above.

It is well established that these approaches have totally failed.

SUMMARY OF THE INVENTION

The throwaway toothbrush according to this invention overcomes the disadvantages indicated above and has the following advantages: it is very economical; it has a sufficient supply of toothpaste for one complete cleaning; it is easy to use and, because it can be thrown away, eliminates the need for subsequent washing and the concern of not fogetting it. Moreover, it avoids the possiblity of inadvertent discharge of the dentifrice.

These results are a direct consequence of the special design and construction of the toothbrush according to the present invention which, because it does not have to meet strength conditions consistent with the usual requirement of durability, can be made of an economical material, is easy to produce with a minimum of cost-adding steps, and is designed in its functional aspect so that the addition of dentifrice and its dispensing during use will be extremely simple.

Thus, our brush consists of a handle or support made of injection moldable, substantially hard, synthetic material capable of withstanding the efforts involved in normal use without breaking. In form, it is similar to that of traditional handles for ordinary toothbrushes. A cavity is provided in this handle into which can be inserted by simple hand pressure a body of material, also synthetic and injection moldable but less hard or flexible, which body extends into an area of long and thin points, in the manner of parallel bristles, which occupy a volume similar to that of the bristles of the aformentioned ordinary toothbrushes, with the particular feature that these points are obtained in the course of the same molding process as the aforesaid body which can be inserted into the handle so that the body and bristles may be integrally formed. At the same time, this insertable unit has an elongated chamber of a length about equal to the longitudinal length of the group of points or bristles and which constitutes the reservoir for holding dentifrice. Near one of the ends of this reservoir, there is an opening in the side which connects it to the flexible point or bristle area so that when the dentifrice is pressed against this end, the dentifrice is transferred into the spaces between the aforesaid points. To permit this pressing effect, a plunger is included, preferably cylindrical and elongated in form, and movable back and forth into the reservoir, projecting through the end opposite the aforesaid side opening or orifice and having a small tab extending upwardly in such a way as to constitute a suitable means of pushing with a finger or fingernail of the hand that holds the brush.

There has thus been outlined rather broadly the more important features of the invention in order that the detailed description thereof that follows may be better understood, and in order that the present contribution to the art may be better appreciated. There are, of course additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description and are shown in the accompanying drawings forming a part of the specification wherein:

FIG. 1 is a view in perspective of a throwaway toothbrush ready for use, in accordance with the present invention;

FIG. 2 is an exploded view of the same throwaway toothbrush as in FIG. 1;

DESCRIPTION OF THE PREFERRED EMBODIMENTS

Figure 3:
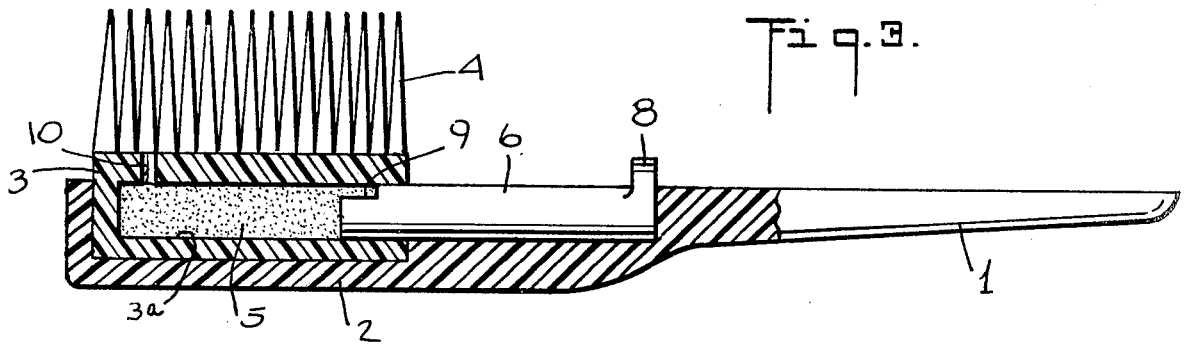
FIG. 3 is a lengthwise partial cross-sectional view of the same brush, loaded with dentifrice, preferably a low-viscosity paste.
Figure 4:
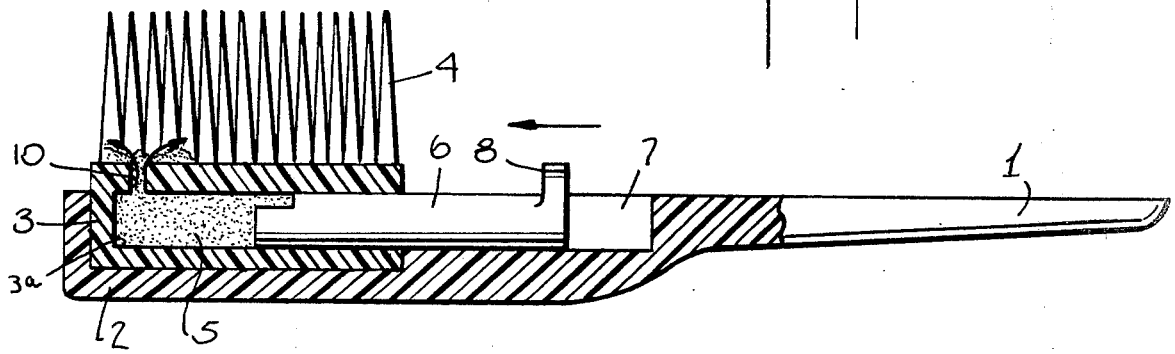
FIG. 4 is a cross-section similar to that of FIG. 3 illustrating transfer of dentifrice to the cleaning point or bristle area.

On all of the Figs., the reference numerals correspond to the same or equivalent component parts of the unit according to the example chosen for this explanation of the present invention.

As can be noted on the Figs., the toothbrush according to this invention consists of a long sturdy handle 1, one end of which expands to form a rectangular box open on the upper face of the end 2, and designed frictionally to hold a flexible and injection moldable plastic body 3, shaped to fit on the bottom of the internal cavity of the box and formed with a great many flexible points or bristles 4 on top, and inside a lengthwise extending cylinder 3*a* of which the movable plunger 6 is located, the handle 1 having a groove of limited length 7 in which the plunger is normally nested.

In one suitable form of embodiment, this plunger consists of a cylindrical stem 6, with a perpendicular tab 8 at the end remote from the bristles suitable for manual pushing. A drop or cut 9 may be provided at its opposite end of the plunger or piston 6.

An orifice 10 connects the chamber 5 with an area of the bristles in order to facilitate the transfer of dentifrice for purposes of conventional cleaning, this orifice being near the end opposite the chamber opening.

Figure 5:
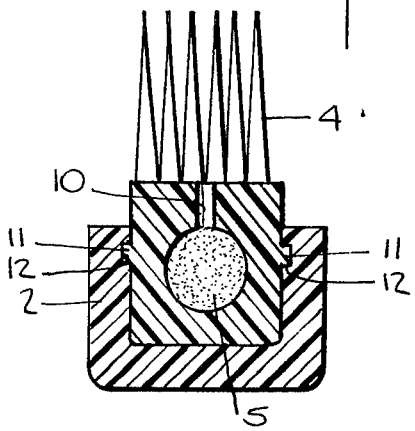
FIG. 5 is a transverse cross-section of the same brush as in the above Figs.
Figure 6:
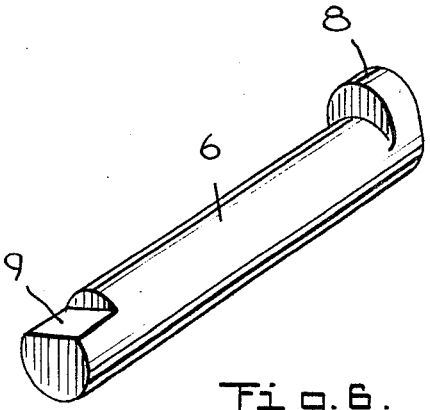
FIG. 6 is a view in perspective of an appropriate version of the dentifrice plunger unit or piston.

In order to provide a more secure fit of the body 3 into the box 2, it is contemplated, in one optional variation, to include small lateral tabs 11 (FIGS. 2 and 5) which, because of the very flexibility of the material of this body, can be pressed into corresponding grooves 12 provided for the purpose on the inside of the less flexible walls of the box.

As can be seen from the example described, the brush according to this invention is very economical, simple to manufacture and assemble, with a minimum involvement of labor or manufacturing equipment, so that for these reasons, as well as because it can be made in inexpensive materials, its overall cost will be low. It will also be seen that practically all of the dentifrice is used, thus minimizing waste. Consequently, it can be an element of practically negligible economic impact capable of being freely distributed as a means of advertising, and within the reach of the majority of people who eat meals outside their home. Therefore, this brush can be dispensed through suitable devices that can be coin-operated, in restaurants, tobacco shops, etc., and can be given to customers of airlines, hotels and the like.

We believe that the construction and operation of our novel disposable toothbrush will now be understood and that the advantages thereof will be fully appreciated by those persons skilled in the art.

We claim:

1. A disposable toothbrush comprising: a handle having in one end a first cavity, a second cavity of less volume than said first cavity, a bristle holder body frictionally housed in said first cavity and formed with a cylinder extending axially of said handle and under said bristles, a port establishing communication between said cylinder and the space between said bristles to permit the passage of dentifrice from said cylinder to said space, and a plunger normally positioned in said second cavity and movable axially in said cylinder to force dentifrice from said cylinder through said port.

2. A throwaway toothbrush of the type comprising a handle and a large number of parallel flexible points near one end of the handle, characterized by an elongated body, bristles integral with said body, means defining a cavity in said handle, a second body being positioned in said cavity and being formed with a cylinder for containing a supply of dentifrice, and means for transferring said dentifrice to the spaces between the aforesaid bristles, and further characterized in that one of said second body and said means defining a cavity is formed with at least two thin flexible projections on its lateral surfaces which protrude perpendicular to those surfaces, and the other of said second body and said means defining a cavity is formed with corresponding grooves in the lateral surfaces thereof into which said projections can be inserted.

* * * * *